US005173032A

United States Patent [19]

Taguchi et al.

[11] Patent Number: 5,173,032

[45] Date of Patent: Dec. 22, 1992

[54] NON-CLUTCH COMPRESSOR

[75] Inventors: Tatsuhisa Taguchi, Katano; Yoshikazu Abe, Neyagawa, both of Japan

[73] Assignee: Matsushita Electric Industrial Co., Ltd., Osaka, Japan

[21] Appl. No.: 830,750

[22] Filed: Feb. 7, 1992

Related U.S. Application Data

[63] Continuation of Ser. No. 545,894, Jun. 29, 1990.

[30] Foreign Application Priority Data

Jun. 30, 1989 [JP] Japan ..... 1-170147

[51] Int. Cl.[5] ..... F04B 1/26

[52] U.S. Cl. ..... 417/222.2; 417/295; 417/269

[58] Field of Search ..... 417/222.5, 295, 441, 417/269, 222

[56] References Cited

U.S. PATENT DOCUMENTS

| | | | |
|---|---|---|---|
| 4,729,718 | 3/1988 | Ohta | 417/222.5 |
| 4,730,986 | 3/1988 | Kayukawa | 417/222.5 |
| 4,747,754 | 5/1988 | Fujii | 417/222.5 |
| 4,801,248 | 1/1989 | Tojo | 417/269 |
| 4,842,488 | 6/1989 | Terauchi | 417/222.5 |
| 4,867,649 | 9/1989 | Kawashima et al. | 417/222.5 |

FOREIGN PATENT DOCUMENTS

| | | | |
|---|---|---|---|
| 674 | 1/1987 | Japan | 417/222.5 |
| 62-191673 | 8/1987 | Japan . | |
| 282182 | 12/1987 | Japan | 417/222.5 |

*Primary Examiner*—Richard A. Bertsch
*Assistant Examiner*—Peter Korytnyk
*Attorney, Agent, or Firm*—Wenderoth, Lind & Ponack

[57] ABSTRACT

In a non-clutch compressor, by controlling a differential pressure between a crank chamber accommodating an oscillating plate therein and a cylinder chamber in a suction stroke, an incline angle of the oscillating plate is sequentially changed so that a maximum stroke of a piston is changeable. The compressor includes a passage opening and closing device arranged at an inlet section of one of a suction pipe connecting with a suction chamber of the compressor and the suction chamber, and a pressure control valve arranged between a discharge chamber and the crank chamber, the valve opening in a case where pressure in the suction chamber is less than a set value. In the compressor, a cross-sectional area (A) of a passage of a discharge hole for connecting the crank chamber with the suction chamber is expressed by an equation: $0.5<(A)<1.8$ mm$^2$.

4 Claims, 4 Drawing Sheets

NON-CLUTCH COMPRESSOR

This application is a continuation of now abandoned application Ser. No. 07/545,894 filed on Jun. 29, 1990.

BACKGROUND OF THE INVENTION

The present invention relates to a non-clutch compressor for employment in an automobile chilling unit.

Known refrigerant compressors for employment in an automobile chilling unit are driven directly by an engine through an electromagnetic clutch and belt in the following manner. The field core of the electromagnetic clutch is energized when the operation of the compressor is required, and a friction plate called an armature is attracted to a rotor pulley by magnetic force to transmit driving force from the engine to a shaft of the compressor. On the other hand, the energizing of the field core is stopped when the operation of the compressor is not required, and only the pulley races.

Recently, refrigerant compressors capable of changing their cooling capacity by themselves have come in to practice. Of the compressors, oscillating swash plate type compressors can change the stroke of the piston within 5–100% by changing the pressure in the crank chamber and have high capacity control efficiency.

On the basis of oscillating swash plate type compressors, various types of compressors having no conventional electromagnetic clutch, which are called non-clutch compressors, have been proposed. For example, such a compressor is disclosed in Japanese Laid-open Patent Publication No. 62-191673, as shown in FIG. 5.

The compressor disclosed therein is of the variable capacity type, and is so constructed that adjustment of the pressure in a crank chamber 2 accommodating an oscillating plate 1 causes the incline angle of the plate 1 to change, so that the discharge capacity can be changed. As shown in FIG. 6, the variable capacity type compressor, the oscillating swash plate type compressor, comprises first and second passages 4 and 5 independently arranged therein and connecting the crank chamber 2 with a suction pressure chamber 3. A third passage 7 connects the crank chamber 2 with a discharge pressure chamber 6. A pressure control valve 8 is arranged in the first passage 4, closing when the pressure in the suction pressure chamber 3 is less than a predetermined set value and opening when the pressure is not less than the value to connect the crank chamber 2 with the suction pressure chamber 3 through the first passage 4. A change valve 9 is provided for closing the first passage 4 and opening the second and third passages 5 and 7 when the pressure in the discharge pressure chamber 6 is less than a predetermined set value, and opening the first passage 4 and closing the second and third passages 5 and 7 when the pressure in the discharge pressure chamber 6 is not less than the values. A throttling mechanism is arranged in the second passage 5 and throttles flow so that the cross-sectional area of the second passage 5 is less than that of the third passage 7.

The necessary conditions under which the non-clutch compressor comes in to practice are as follows: (1) it can assure the reliability and durability of the compressor not less than those of a compressor with an electromagnetic clutch; (2) it can prevent fuel consumption drop throughout the year even though it is always operated; (3) the parts added instead of an electromagnetic clutch have no disadvantage in configuration and cost.

With respect to the above conditions, every mechanisms presently proposed may not be realized. It appears that for example, it is required for the above-described known compressor to remedy some disadvantages, such as problems concerning a lubricating method of parts in the compressor in addition to a complicated pressure control construction in the crank chamber thereof.

In order to realize the non-clutch compressor, it is required to remedy the lubricating problems such as wear, burning, and degradation of sealing of parts in the compressor by only adding smaller and lower-cost parts. Furthermore, since the compressor is operated even though the cooling operation is not required, it is constructionally required to greatly reduce the cooling capacity and the load power at that time.

SUMMARY OF THE INVENTION

Accordingly, an essential object of the present invention is to provide a non-clutch compressor capable of satisfying the conditions, remedying the lubricating problems, and greatly reducing the cooling capacity and the load power when a cooling operation is not required.

In accomplishing these and other objects, according to one preferred embodiment of the present invention, there is provided a non-clutch compressor in which, by controlling a differential pressure between a crank chamber accommodating an oscillating plate therein and a cylinder chamber in a suction stroke, an incline angle of the oscillating plate is sequentially changed so that a maximum stroke of a piston is changeable. The non-clutch compressor comprises a passage opening and closing device arranged at an inlet section of one of a suction pipe connecting with a suction chamber of the compressor and the suction chamber, and a pressure control valve arranged between a discharge chamber and the crank chamber, the valve opening in a case where pressure in the suction chamber is less than a set value. A cross-sectional area (A) of a passage of a discharge hole for connecting the crank chamber with the suction chamber is expressed by an equation: $0.5<(A-)<1.8\ mm^2$.

By the above construction of one aspect of the present invention, the operation is as follows. The passage opening and closing device is opened in normal operation. The device is closed when the discharge from the compressor is not required. As a result thereof, the pressure in the suction chamber decreases, the pressure control valve is opened, and high-pressure gas flows into the crank chamber to increase the pressure in the crank chamber and make the oscillating plate move to minimize the incline angle thereof. Thus, the stroke of the piston is minimized to greatly reduce a required torque. The inside of the compressor is lubricated by performing the very small reciprocating motion of the piston which is required when gas flow is generated from the discharge chamber to the crank chamber through each sliding section, further from the crank chamber to the suction chamber through the discharge hole serving as a throttling section.

BRIEF DESCRIPTION OF THE DRAWINGS

These and other objects and features of the present invention will become clear from the following description of the preferred embodiments thereof with reference to the accompanying drawings, in which.

DETAILED DESCRIPTION OF THE EMBODIMENTS

Figure 1:
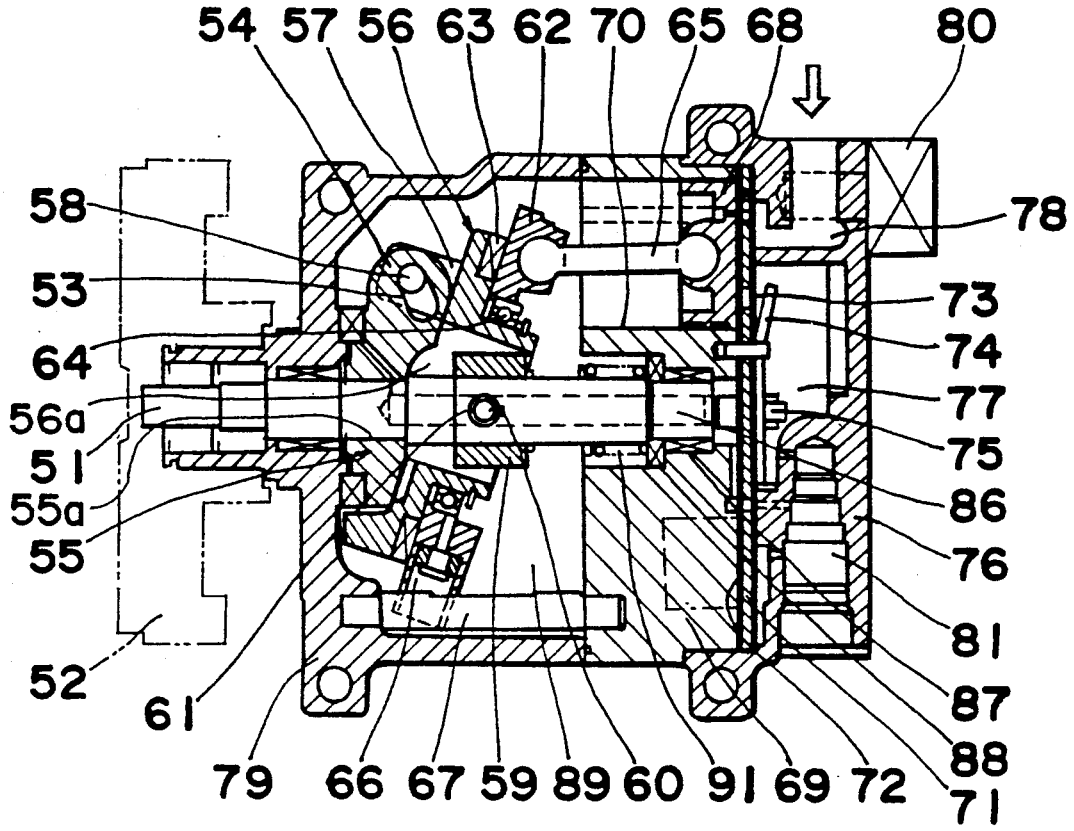
FIG. 1 is a longitudinal sectional view showing a state where a passage opening and closing valve of a non-clutch compressor according to one embodiment of the present invention is opened.

Before the description of the present invention proceeds, it is to be noted that like parts are designated by like reference numerals throughout the accompanying drawings.

FIG. 1 is a view showing the whole construction of the non-clutch compressor according to one embodiment of the present invention. Reference numeral 51 denotes a shaft normally rotating a driving force from the outside through a pulley 52. The shaft 51 is inserted into a center hole 55*a* of a drive plate 55 having a projection 54 with a long hole 53 for positioning, under pressure. Reference numeral 56 denotes a rotating journal having a pair of projections 57 on the side of the drive plate 55. The journal 56 is suspended by a positioning pin 58 passing through the long hole 53 and the pair of projections 57 and then rotates while the projection 54 of the drive plate 55 is put between the pair of projections 57 of the journal 56. The journal 56 has a hole 56*a* having a pair of plain walls at the middle portion thereof. A shaft sleeve 59 is inserted slidably along its axial direction coincident with the axis of the shaft 51 into the hole 56*a* of the journal 56. The shaft sleeve 59 has a pair of positioning holes 60 on its axis. The operation of the journal 56 is regulated by a positioning pivot pin 61 inserted into the holes 60 of the journal 56. That is, the operation of the journal 56 is regulated with the long hole 53 of the drive plate 55 and the positioning hole 60 of the shaft sleeve 59, resulting in a mechanism capable of changing the incline angle with respect to the shaft 51.

There is an oscillating plate 62 on the side opposite to the side of the drive plate 55. The oscillating plate 62 is supported with a thrust bearing 63 and a radial bearing 64. At the outer circumference of the oscillating plate 62, a plurality of rods 65 with universal couplings on both ends thereof are arranged and one end thereof is fastened thereto. On a predetermined portion of the outer circumferential section of the oscillating plate 62, a rotary prevention member 66 is arranged to regulate the rotation of the oscillating plate 62, resulting in regulation of the rotation of the oscillating plate 62 by a guide plate 67.

On the other end of each of the rods 65, a piston 68 is arranged through a universal coupling. Each of the plural pistons 68 can reciprocally move in each of plural cylinder bores 70 arranged at a cylinder 69. Reference numeral 71 denotes a valve plate. On the cylinder side of the valve plate 71, a suction valve 72 is fixed, and on the side opposite to the cylinder side, a discharge valve 73 and a discharge valve guard 74 are fixed, with fixing members 75 such as a bolt and a nut. Reference numeral 76 denotes a rear cover with a discharge chamber 77 formed at the middle section thereof and a suction chamber 78 formed at the outer circumferential section thereof.

The mechanism such as the oscillating plate 62 is accommodated in a front cover 79. The shaft 51 is rotatably supported with the front cover 79 and the cylinder 69 in a thrust and a radial directions.

Figure 3:
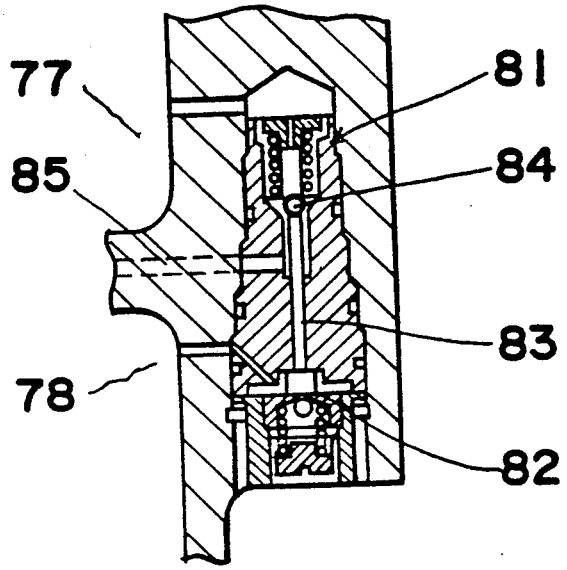
FIG. 3 is a view showing the construction of a pressure control valve of the compressor.
Figure 4:
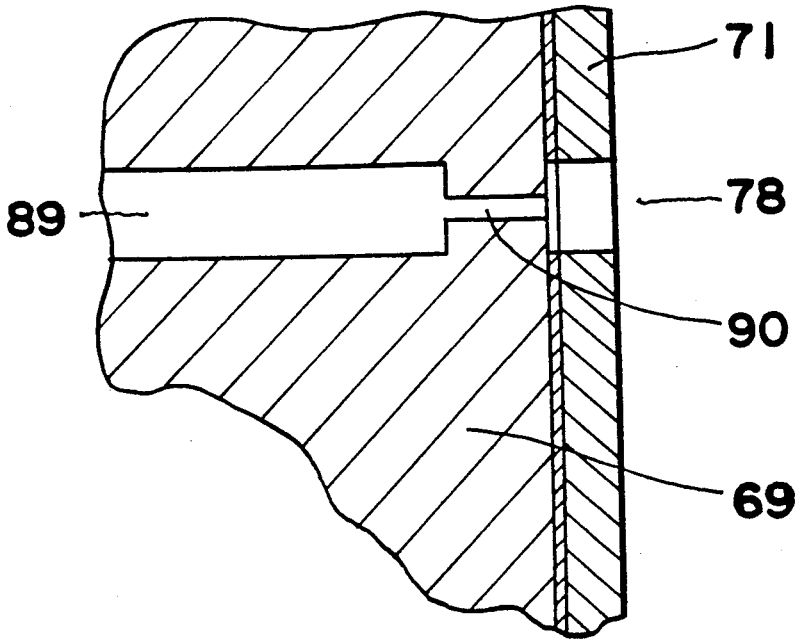
FIG. 4 is an enlarged view of a discharge hole of the compressor.
Figure 5:
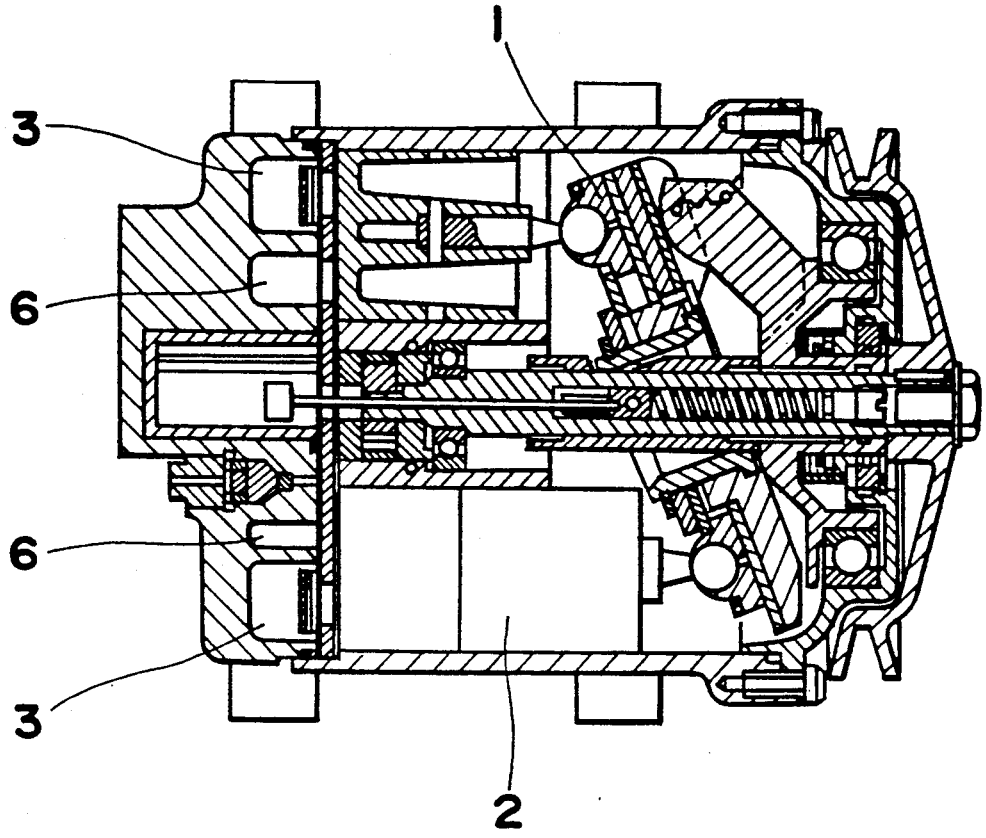
FIG. 5 is a longitudinal sectional view of a known non-clutch compressor.
Figure 6:
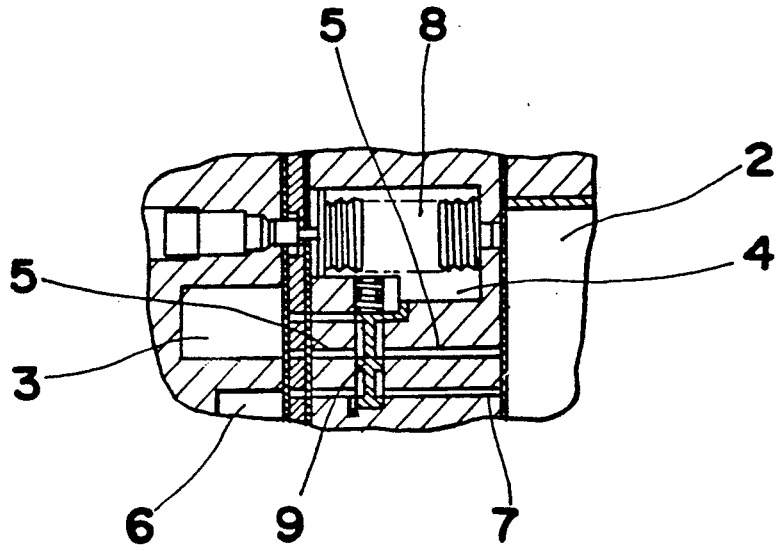
FIG. 6 is a longitudinal sectional view, in detail, showing a pressure control mechanism of the known non-clutch compressor.

The variable capacity mechanism section of the compressor will be described hereinbelow. Reference numeral 80 denotes an electromagnetic valve for opening and closing a passage, the valve 80 arranged in an inlet section to the suction chamber 78. In the rear cover 76 a pressure control valve 81 is arranged. FIG. 3 shows the detail of the pressure control valve 81. Reference numeral 82 denotes a diaphragm. The pressure in the suction chamber 78 is applied to the inside of the diaphragm 82 and the atmospheric pressure is applied to the outside of the diaphragm 82. Then, in the pressure control valve 81, when the suction pressure is not less than a predetermined set value, the valve 81 is closed, while when the suction pressure is less than the set value, the valve 81 is opened in the following manner. That is, a presser bar 83 connected to the diaphragm 82 presses a steel ball 84 upwardly in FIG. 3. Then, a part of high-pressure gas in the discharge chamber 77 passes through a pressure supply path 85, a passage 86 in the shaft 51, and a gap of a radial bearing 87 and a gap of a thrust bearing 88, and thereafter flows into a crank chamber 89. In FIG. 4, reference numeral 90 denotes a discharge hole formed in the cylinder 69, that is, a capillary having high flow resistance and always connecting to the suction chamber 78. On the peripheral section of the shaft 51, a coil-shaped spring 91 is arranged between the shaft sleeve 59 and the thrust bearing 88, with the result that the spring 91 urges in a direction in which the incline angle of the journal 56 is increased.

The operation of the compressor will be described hereinbelow.

In the oscillating swash plate type compressor, the journal 56 with an incline angle rotates in accordance with the rotation of the shaft 51, so that the oscillating plate 62 carries out oscillating motion. As a result, each piston 68 moves reciprocally so as to suck, compress, and discharge refrigerant gas. Such an action normally causes the oscillating plate 62 to receive the gas pressure in the direction in which the incline angle is increased. In the variable capacity type compressor, the pressure in the crank chamber 89 rises from the normal suction pressure, and then when the pressure in the crank chamber 89 is not less than a set value, force is applied in a direction in which the incline angle is decreased. Such an operation makes the pressure in the crank chamber 89 increase sequentially while supplementarily using the urging force of the spring 91. As a result, the incline angle is sequentially and gradually decreased by the mechanism.

In addition to the fundamental operation of the variable capacity mechanism in the oscillating swash plate type according to the embodiment described above, the change of the state in accordance with the operation of the electromagnetic valve 80 for opening and closing the passage arranged in the inlet section to the suction chamber 78 will be described hereinbelow.

The electromagnetic valve 80 holds an opening state in a normal cooling operation. The compressor performs the known variable capacity operation. That is, when the suction pressure of the compressor is not less than a predetermined set value, the journal 56 rotates in a state where the journal 56 inclines at the maximum incline angle, so that the piston 68 sucks the refrigerant gas until the piston 68 moves to the maximum stroke thereof, and an operation in accordance with the maximum discharge amount of the compressor is performed. Then, when the suction pressure is less than the set value, the pressure control valve 81 is opened and the pressure in the crank chamber 89 increases to start to make the incline angle of the journal 56 reduce. As a result, the suction pressure is held to a constant set value, so that the cooling capability is constant irrespective of change of revolution number and the cooling capability thereof is suitably controlled in accordance with each season. The required torque is greatly reduced according to reduction of the discharge pressure and the piston stroke, as compared with a compressor without a variable capacity mechanism, so that the refrigerating cycle with high efficiency can be performed as a cooling system.

Next, the operation in a case where it is unnecessary to perform the cooling operation will be described hereinbelow.

Figure 2:
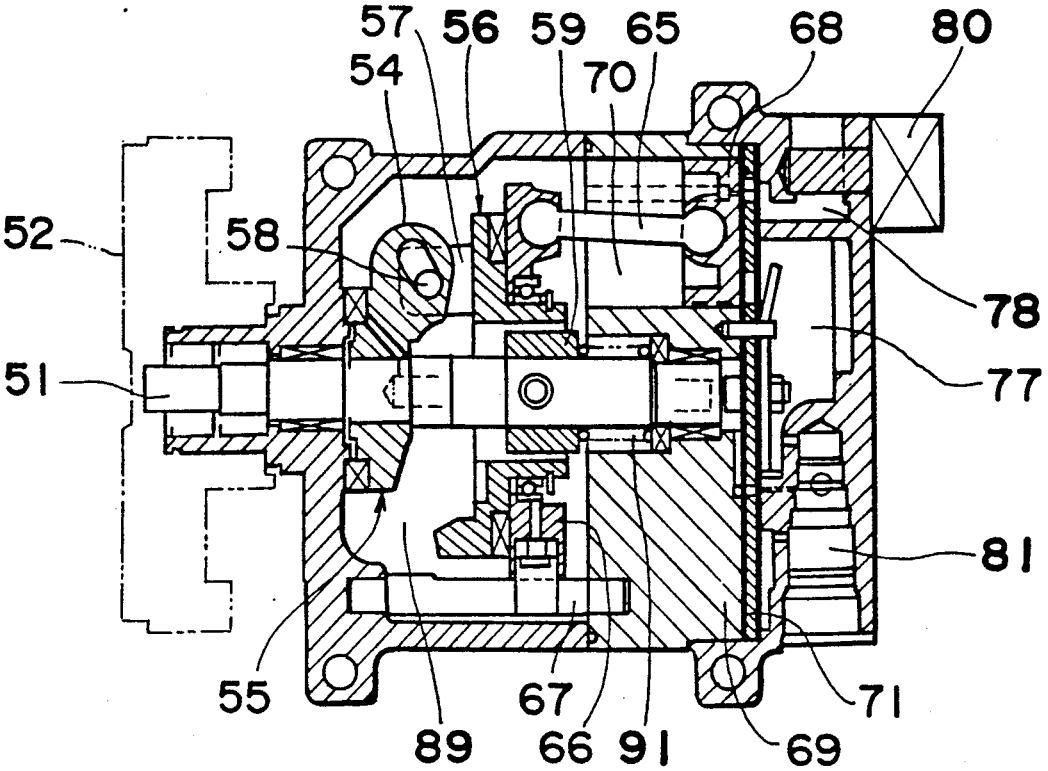
FIG. 2 is a longitudinal sectional view showing a state where the passage opening and closing valve is closed.
Figure 7:
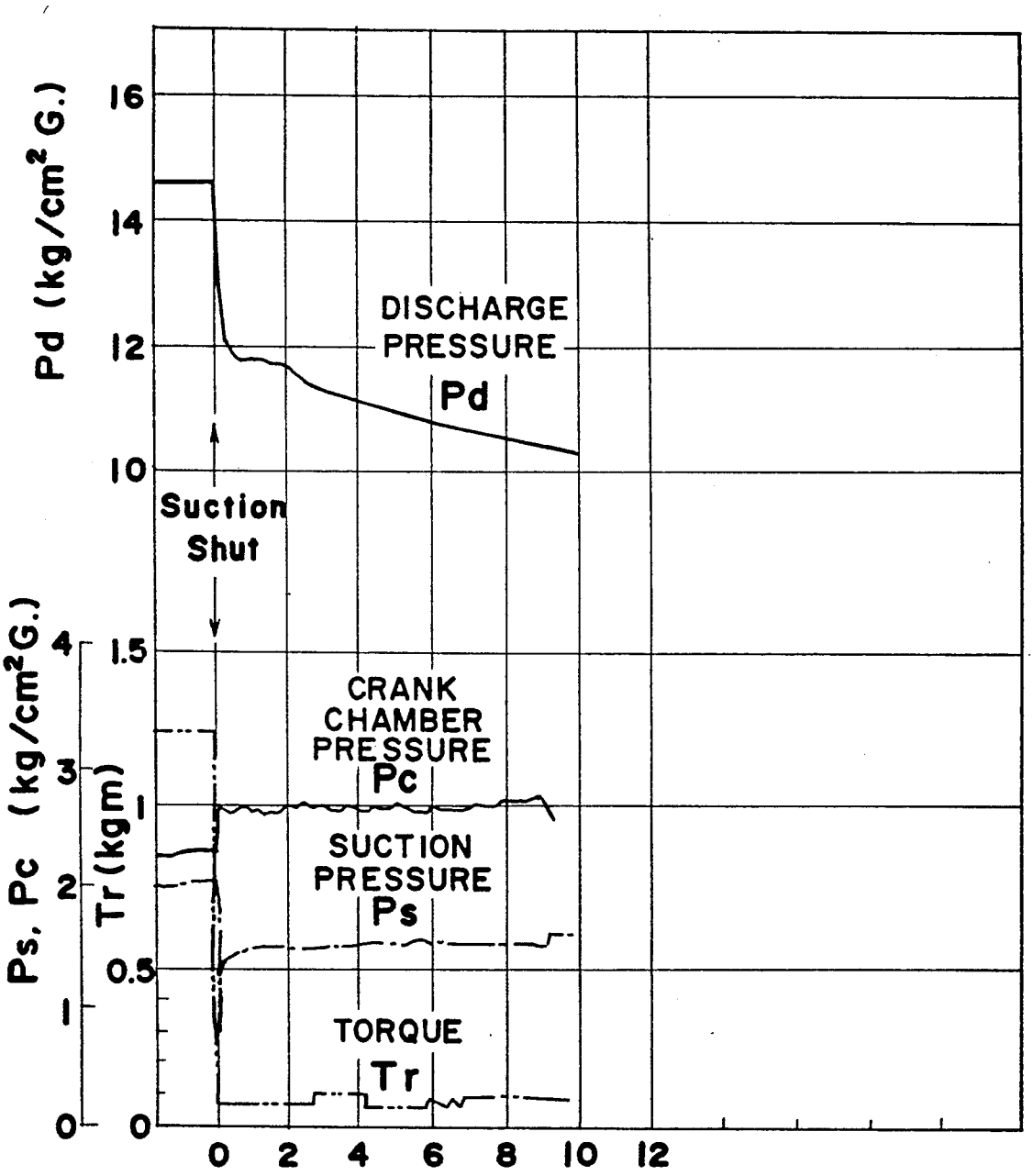
FIG. 7 is a diagram between the pressure and the torque in operating the compressor according to the embodiment of the present invention.

In this case, as shown in FIG. 2, the electromagnetic valve 80 is closed. Then, it prevents the compressor from sucking, resulting in rapid decrease of the pressure in the suction chamber 78. Thus, it causes the differential pressure between the pressure in the crank chamber 89 and that in the suction chamber 78 to generate. On the other hand, the pressure control valve 81 is opened, so that the pressure in the crank chamber 8 increases according to inflow of the high-pressure gas. As a result, the incline angle of the journal 56 reduces towards the minimum value, resulting in a balanced position between the force of the journal 56 and that of the spring 91 where the journal 56 has the minimum incline angle. At this time, the required torque is several percents of that in the maximum stroke operation, in accordance with minimization of the stroke and decrease of the discharge pressure in response to reduction of the discharge. Actual experimental results are shown in FIG. 7. As shown in FIG. 7, it appears that the differential pressure holds between the discharge chamber 77, the crank chamber 89, and the suction chamber 78, with the result that the fluid flows in the compressor and the sliding section in the compressor is lubricated with the inlet gas from the discharge chamber 77 described previously.

One of the features in the above-described construction is that the discharge hole 90 is formed by the capillary between the suction chamber 78 and the crank chamber 89. Fluid resistance in some extent is required therebetween to generate the differential pressure for making the incline angle of the journal 56 be to the minimum value. The extent of the resistance is experimentally determined by the period of time required when the piston returns from the minimum stroke to the maximum stroke. The experimental results of the system showed that the cross-sectional area (A) of the passage of the discharge hole 90 is expressed by the following inequality supposing that the volume of the crank chamber 89 is approximately 1 liter.

$$0.5<(A)<1.8\text{mm}^2$$

According to the embodiment of the present invention, the variable capacity compressor of the oscillating swash plate type is so constructed that a simple opening and closing device such as the electromagnetic valve is arranged at the refrigerant inlet passage of the suction chamber, the cross-sectional area (A) of the discharge hole between the crank chamber and the suction chamber is determined by the equation $0.5<(A)<1.8\ \text{mm}^2$, and the pressure control valve for opening in the case where the suction pressure is less than the set value is arranged at the connection passage between the high-pressure chamber and the crank chamber. In addition to the normal variable capacity function, the opening and closing device is closed in the operation unnecessary for the cooling operation, so that the refrigerant flows inside the compressor to lubricate while the cooling capability is zero and the required torque is held to a very small value. Thus, a cheap and light compressor can be obtained with excellent durability and reliability and reduced power loss.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A non-clutch compressor, comprising:

a crank chamber;

a cylinder connected to said crank chamber;

an oscillating plate in said crank chamber having a piston connected thereto, said piston being disposed in said cylinder for movement therein, means for mounting said oscillating plate in said crank chamber such that said oscillating plate can be oscillated to move said piston in said cylinder and such that said oscillating plate has a variable angle of inclination for varying the amount of movement of said piston in said cylinder;

a suction chamber fluidly connected to said cylinder for a suction stroke of said piston, said suction chamber having a suction inlet;

a discharge chamber fluidly connected to said cylinder for a discharge stroke of said position;

a passage opening and closing means disposed in said suction inlet for opening and closing said suction inlet;

a pressure control valve means connected between said discharge chamber and said crank chamber for fluidly connecting said discharge chamber with said crank chamber when said suction inlet is opened by said passage opening and closing means in a normal cooling operation and when the pressure in said suction chamber is less than a predetermined value for regulating the angle of inclination of said oscillating plate;

a discharge hole fluidly connecting said crank chamber with said suction chamber, said discharge hole having a passage with a predetermined cross-sectional area; and a driving means for driving said oscillating plate, said driving means including a belt pulley and said means for mounting including a rotary shaft directly connected to said belt pulley.

2. The non-clutch compressor of claim 1, wherein said passage opening and closing means comprises an electromagnetic valve.

3. The non-clutch compressor of claim 1, wherein said predetermined cross-sectional area of said passage of said discharge hole is greater than 0.5 $mm^2$ but less than 1.8 $mm^2$.

4. The non-clutch compressor of claim 1, wherein said pressure control valve means further fluidly connects said discharge chamber with said crank chamber when said suction inlet is closed by said passage opening and closing means and the pressure in said suction chamber is reduced to less than the predetermined value for regulating the angle of inclination of said oscillating plate.

* * * * *